US011245206B2

(12) United States Patent
Singh

(10) Patent No.: US 11,245,206 B2
(45) Date of Patent: Feb. 8, 2022

(54) MULTI-MODE ANTENNA SYSTEM

(71) Applicant: AVX Antenna, Inc., San Diego, CA (US)

(72) Inventor: Abhishek Singh, San Diego, CA (US)

(73) Assignee: AVX Antenna, Inc., San Diego, CA (US)

( * ) Notice: Subject to any disclaimer, the term of this patent is extended or adjusted under 35 U.S.C. 154(b) by 0 days.

(21) Appl. No.: 16/820,864

(22) Filed: Mar. 17, 2020

(65) Prior Publication Data

US 2020/0303840 A1 Sep. 24, 2020

Related U.S. Application Data

(60) Provisional application No. 62/821,740, filed on Mar. 21, 2019.

(51) Int. Cl.

| | |
|---|---|
| ***H01Q 25/04*** | (2006.01) |
| ***H01Q 9/16*** | (2006.01) |
| ***H01Q 1/48*** | (2006.01) |
| ***H01Q 5/385*** | (2015.01) |
| ***H01Q 9/42*** | (2006.01) |

(52) U.S. Cl.

CPC ..... *H01Q 25/04* (2013.01); *H01Q 1/48* (2013.01); *H01Q 5/385* (2015.01); *H01Q 9/16* (2013.01); *H01Q 9/42* (2013.01)

(58) Field of Classification Search

CPC ..... H01Q 5/385; H01Q 9/42; H01Q 25/04

See application file for complete search history.

(56) References Cited

U.S. PATENT DOCUMENTS

| | | | |
|---|---|---|---|
| 6,040,803 | A | 3/2000 | Spall |
| 6,765,536 | B2 | 7/2004 | Phillips et al. |
| 6,987,493 | B2 | 1/2006 | Chen |
| 7,068,234 | B2 | 6/2006 | Sievenpiper |
| 7,215,289 | B2 | 5/2007 | Harano |
| 7,330,152 | B2 | 2/2008 | Zhang et al. |
| 7,830,320 | B2 | 11/2010 | Shamblin |
| 7,911,402 | B2 | 3/2011 | Rowson et al. |
| 8,362,962 | B2 | 1/2013 | Rowson et al. |
| 8,446,318 | B2 | 5/2013 | Ali et al. |

(Continued)

OTHER PUBLICATIONS

International Search Report and Written Opinion for Application No. PCT/US2020/023120, dated Mar. 17, 2020, 13 pages.

*Primary Examiner* — Ricardo I Magallanes
(74) *Attorney, Agent, or Firm* — Dority & Manning, P.A.

(57) ABSTRACT

A multi-mode antenna system include at least a first modal antenna and a second modal antenna. The first modal antenna is disposed on a ground plane of a circuit board and configurable in a plurality of different modes. The first modal antenna can include a driven element, at least one parasitic element and an active element configured to adjust a reactance of the at least one parasitic element. The multi-mode antenna system further includes a second modal antenna disposed on the ground plane and configurable in a plurality of different modes. The second modal antenna can include a driven element, at least one parasitic element, and an active element configured to adjust a reactance of the at least one parasitic element. The parasitic element of the second modal antenna is positioned such that adjusting the reactance of the parasitic element affects the radiation pattern associated with the first modal antenna.

18 Claims, 15 Drawing Sheets

(56) References Cited

U.S. PATENT DOCUMENTS

| | | | | |
|---|---|---|---|---|
| 8,604,988 | B2 * | 12/2013 | Desclos | H01Q 9/06 343/745 |
| 8,648,755 | B2 | 2/2014 | Rowson et al. | |
| 8,717,241 | B2 | 5/2014 | Shamblin et al. | |
| 9,065,496 | B2 | 6/2015 | Rowson et al. | |
| 9,231,669 | B2 | 1/2016 | Desclos et al. | |
| 9,240,634 | B2 | 1/2016 | Rowson et al. | |
| 9,263,798 | B1 | 2/2016 | Piazza et al. | |
| 9,425,497 | B2 | 8/2016 | Pajona et al. | |
| 9,439,151 | B2 | 9/2016 | Zhu et al. | |
| 9,479,242 | B2 | 10/2016 | Desclos et al. | |
| 9,571,176 | B2 | 2/2017 | Desclos et al. | |
| 9,590,703 | B2 | 3/2017 | Desclos et al. | |
| 9,634,404 | B1 * | 4/2017 | Rowson | H01Q 5/385 |
| 9,755,305 | B2 | 9/2017 | Deslos et al. | |
| 9,755,580 | B2 | 9/2017 | Desclos et al. | |
| 2005/0088358 | A1 | 4/2005 | Larry et al. | |
| 2009/0051611 | A1 * | 2/2009 | Shamblin | H01Q 5/392 343/747 |
| 2013/0135163 | A1 | 5/2013 | Desclos et al. | |
| 2015/0155623 | A1 * | 6/2015 | Shamblin | H01Q 1/243 342/367 |
| 2016/0020838 | A1 * | 1/2016 | Desclos | H04B 7/0602 455/500 |
| 2016/0036127 | A1 | 2/2016 | Desclos et al. | |
| 2018/0351255 | A1 | 12/2018 | Singh et al. | |

* cited by examiner

MULTI-MODE ANTENNA SYSTEM

PRIORITY CLAIM

The present application claims the benefit of priority of U.S. Provisional App. No. 62/821,740, titled "Multi-Mode Antenna System," having a filing date of Mar. 21, 2019, which is incorporated by reference herein.

FIELD

The present disclosure relates generally to multi-mode antenna systems.

BACKGROUND

Multiple input multiple output (MIMO) systems are being increasingly used in wireless communication, for instance in access points, such as WiFi access points. MIMO systems include two or more antennas, which allows signals to be transmitted or received over two or more paths. Antennas in a MIMO system in some instances preferably have high, and preferably, equal efficiencies along with good isolation and low correlation. However, since the multipath environment in which MIMO systems are employed is constantly changing, performance of the communication link can be affected.

SUMMARY

Aspects and advantages of embodiments of the present disclosure will be set forth in part in the following description, or may be learned from the description, or may be learned through practice of the embodiments.

In one aspect, a multi-mode antenna system is provided. The multi-mode antenna system can include a circuit board having a conductive ground plane. The multi-mode antenna system can include a first modal antenna disposed on the ground plane. The first modal antenna can be configurable in one of a plurality of modes. Furthermore, each of the plurality of modes can have a distinct radiation pattern. The first modal antenna can include a driven element, at least one parasitic element, and an active element configured to adjust a reactance of the at least one parasitic element to alter a radiation pattern associated with the driven element. The multi-mode antenna system can further include a second modal antenna disposed on the ground plane. The second modal antenna can be configurable in one of a plurality of modes. Furthermore, each of the plurality of modes can have a distinct radiation pattern. The second modal antenna can include a driven element, at least one parasitic element, and an active element configured to adjust a reactance of the at least one parasitic element of the second modal antenna to alter a radiation pattern associated with the driven element of the second modal antenna. Furthermore, the at least one parasitic element of the second modal antenna is positioned such that controlling the active element of the second modal antenna to adjust the reactance of the at least one parasitic element of the second modal antenna affects the radiation pattern associated with the first modal antenna.

In another aspect, a multi-mode antenna system is provided. The multi-mode antenna system includes a circuit board having a ground plane. The multi-mode antenna system includes a first modal antenna disposed on the ground plane. The first modal antenna is configurable in one of a plurality of modes. Each of the plurality of modes has a distinct radiation pattern. The first modal antenna includes a driven element and at least one parasitic element. The first driven element is positioned adjacent a first edge of the ground plane. The first modal antenna further includes an active element configured to adjust a reactance of the at least one parasitic element to alter a radiation pattern associated with the driven element.

The multi-mode antenna system includes a second modal antenna disposed on the ground plane. The second modal antenna is configurable in one of a plurality of modes. Each of the plurality of modes has a distinct radiation pattern. The second modal antenna includes a driven element and at least one parasitic element. The driven element of the second modal antenna positioned adjacent a second edge of the ground plane. The second modal antenna includes an active element configured to adjust a reactance of the at least one parasitic antenna element of the second modal antenna to alter a radiation pattern associated with the driven element of the second modal antenna.

The multi-mode antenna system includes a third modal antenna disposed on the ground plane. The third modal antenna is configurable in one of a plurality of modes. Each of the plurality of modes has a distinct radiation pattern. The third modal antenna includes a driven element and at least one parasitic element. The driven element of the third modal antenna is positioned adjacent a third edge of the ground plane. The third modal antenna includes an active element configured to adjust a reactance of the at least one parasitic antenna element of the third modal antenna to alter a radiation pattern associated with the driven element of the third modal antenna.

The multi-mode antenna system includes a fourth modal antenna disposed on the ground plane. The fourth modal antenna is configurable in one of a plurality of modes. Each of the plurality of modes has a distinct radiation pattern. The fourth modal antenna includes a driven element and at least one parasitic element. The driven element of the fourth modal antenna is positioned adjacent a fourth edge of the ground plane. The fourth modal antenna further includes an active element configured to adjust a reactance of the at least one parasitic antenna element of the fourth modal antenna to alter a radiation pattern associated with the driven element of the fourth modal antenna. Furthermore, the at least one parasitic element of the second modal antenna is positioned such that controlling the active element of the second modal antenna to adjust the reactance of the at least one parasitic element of the second modal antenna affects the radiation pattern associated with at least one of the first modal antenna, the third modal antenna, or the fourth modal antenna.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
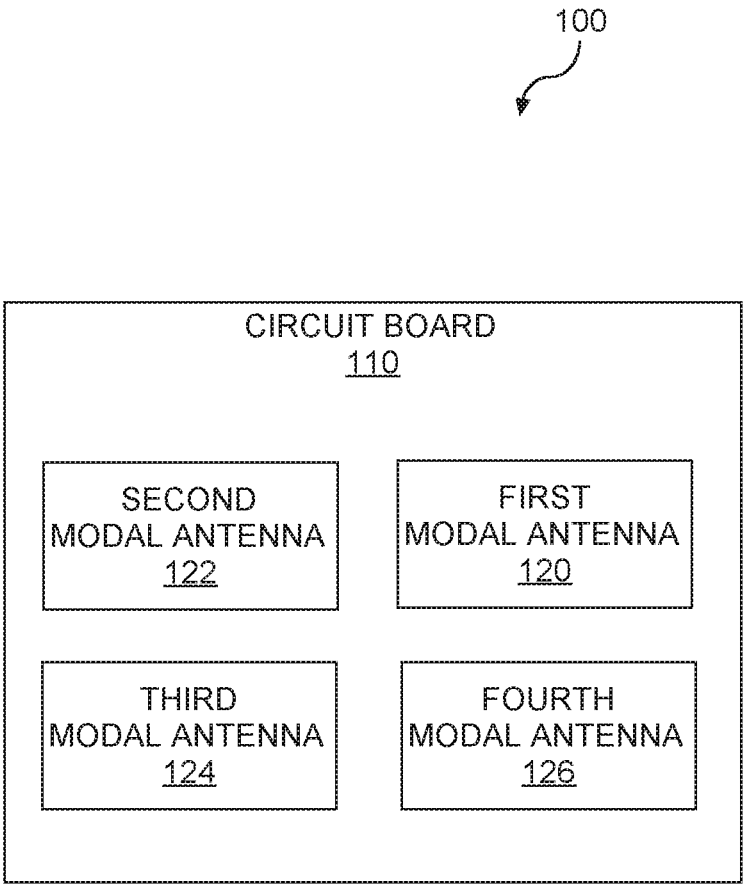
FIG. 1 depicts a block diagram of components of a multi-mode antenna system according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to a multi-mode antenna system. In some implementations, the multi-mode antenna system can be a multiple input multiple output (MIMO) antenna system, such as a 2×2 MIMO system or a 4×4 MIMO system.

While the present disclosure is discussed with reference to a MIMO system for purposes of illustration and discussion, those of ordinary skill in the art, using the disclosures provided herein, will understand that the multi-mode antenna system can be used for diversity applications, array applications, and other applications without deviating from the scone of the present disclosure.

In some embodiments, the multi-mode antenna system can include a plurality of modal antennas disposed on a circuit board (e.g., on a conductive ground plane). For example, the system can include a first modal antenna configurable in a plurality of modes. Each of the plurality of modes can have a distinct radiation pattern. The system can further include a second modal antenna configurable in a plurality of modes. Each of the plurality of modes of the second modal antenna can have a distinct radiation pattern as well. Each modal antenna (e.g., first modal antenna, second modal antenna, etc.) can be configured to receive and transmit over different channels in a MIMO system.

The first modal antenna and the second modal antenna can each include a driven element and at least one parasitic element. Furthermore, the first modal antenna and the second modal antenna can each include an active element configured to alter a reactance of the at least one parasitic element by way of a variable reactance or shorting to ground. It should also be appreciated that the active element can include at least one of a tunable capacitor, MEMS device, tunable inductor, switch (e.g., single pole quadruple throw), a tunable phase shifter, a field-effect transistor, a diode, or combinations of the foregoing.

In some implementations, the driven element of the first modal antenna can be positioned adjacent a first edge of the ground plane. Furthermore, the driven element of the second modal antenna can be positioned adjacent a second edge of the ground plane. The second edge of the ground plane can be substantially perpendicular to the first edge of the ground plane so that the first modal antenna and the second modal antenna are generally perpendicular (e.g., lines associated with a long dimension of the modal antennas can intersect at an angle within 15° of perpendicular). In some implementations, the driven element of the second modal antenna can be rotated relative to the driven element of the first modal antenna in a plane that is substantially parallel to the ground plane. For instance, the driven element of the second modal antenna can be rotated in the plane by about 90 degrees relative to the driven element of the first modal antenna. It should be appreciated, however, that the driven element of the second modal antenna can be rotated in the plane by any suitable amount relative to the driven element of the first modal antenna.

In some implementations, the at least one parasitic element of the first modal antenna can include a first parasitic element and a second parasitic element. The first parasitic element can be disposed outside an antenna volume defined between the ground plane and the driven element of the first modal antenna. Conversely, the second parasitic element can be disposed within the antenna volume.

In some implementations, the at least one parasitic element of the second modal antenna can include a first parasitic element and a second parasitic element. The first parasitic element can be disposed outside an antenna volume defined between the ground plane and the driven element of the second modal antenna. Conversely, the second parasitic element can be disposed within the antenna volume.

In some implementations, the first parasitic element of both the first modal antenna and the second modal antenna can include a first linear portion coupled to the ground plane. The first parasitic element can further include a second linear portion extending from the first linear portion. The second linear portion can be spaced apart from the ground plane and substantially perpendicular to the first linear portion. Furthermore, the first parasitic element can include a third linear portion extending from the second linear portion. The third linear portion can be spaced apart from the ground plane and substantially perpendicular to the second linear portion.

In some implementations, the first parasitic element of the second modal antenna can be rotated relative to the first parasitic element of the first modal antenna in a plane that is substantially parallel to the ground plane. For example, the first parasitic element of the second modal antenna can be rotated in the plane by about 90 degrees relative to the first parasitic element of the first modal antenna along the plane. It should be appreciated, however, that the first parasitic element of the second modal antenna can be rotated in the plane by any suitable amount.

In some embodiments, the first and second modal antennas can be positioned on the ground plane of the circuit board such that a parasitic element associated with one modal antenna can be used to affect the radiation pattern of the other modal antenna. For example, the radiation pattern of the first modal antenna can be affected via adjustments to the reactance of the first parasitic element of the second modal antenna. Likewise, the radiation pattern of the second modal antenna can be affected via adjustments to the reactance of the first parasitic element of the first modal antenna. In this manner, additional modes (e.g., radiation patterns) for both first modal antenna and the second modal antenna can be generated.

In some implementations, the multi-mode antenna system can be a 4×4 MIMO system that includes four modal antennas disposed on a ground plane of a circuit board. Each of the four modal antennas can include a driven element and at least one parasitic element. Furthermore, each of the four modal antennas can include an active tuning element. The active tuning element can be configured to adjust a reactance of the at least one parasitic antenna element of the corresponding modal antenna to alter a radiation pattern associated with the driven element of the corresponding modal antenna.

In some implementation, the at least one parasitic element of a first modal antenna of the 4×4 MIMO system can be positioned such that controlling the active element of the first modal antenna to adjust the reactance of the at least one parasitic element of the first modal antenna affects the radiation pattern associated with at least one other modal antenna in the 4×4 MIMO system. More specifically, the at least on parasitic element of the first modal antenna be affect the radiation associated with the at least one other modal antenna such that additional modes can be generated for the at least one other modal antenna.

The multi-mode antenna system of the present disclosure can provide numerous technical benefits. For instance, the first modal antenna and the second modal antenna can be oriented relative to one another to provide additional modes for the first modal antenna and the second modal antenna. The additional modes can allow the multi-mode antenna system to provide isotropic (e.g., omnidirectional) coverage over a greater range of frequencies. For instance, the additional modes can allow the multi-mode antenna system to provide isotropic coverage at both low frequency bands (e.g., 700 MHz to 800 MHZ) and high frequency bands (e.g., 1800 MHz to 2200 MHz). In diversity applications, the diversity gain of the multi-mode antenna system can be increased.

As used in the specification and the appended claims, the terms "first" and "second" may be used interchangeably to distinguish one component from another and are not intended to signify location or importance of the individual components. The use of the term "about" or "substantially" in conjunction with a numerical value is intended to refer to within ten percent (15%) of the stated numerical value.

Referring now to FIG. 1, an example embodiment of the multi-mode antenna system 100 is provided according to example embodiments of the present disclosure. As shown, the multi-mode antenna system 100 can include a circuit board 110. In some implementations, the multi-mode antenna system 100 can include four separate modal antennas (e.g., first modal antenna 120, second modal antenna 122, third modal antenna 124, and fourth modal antenna 126). In alternative implementations, the multi-mode antenna system 100 can include more or fewer modal antennas. For example, in some implementations, the multi-mode antenna system 100 can include two modal antennas (e.g., first modal antenna 122 and second modal antenna 124). It should be appreciated that each of the plurality of modal antennas is configurable in a plurality of modes. It should also be appreciated that each of the plurality of modes can have a distinct radiation pattern and/or polarization.

Figure 2:
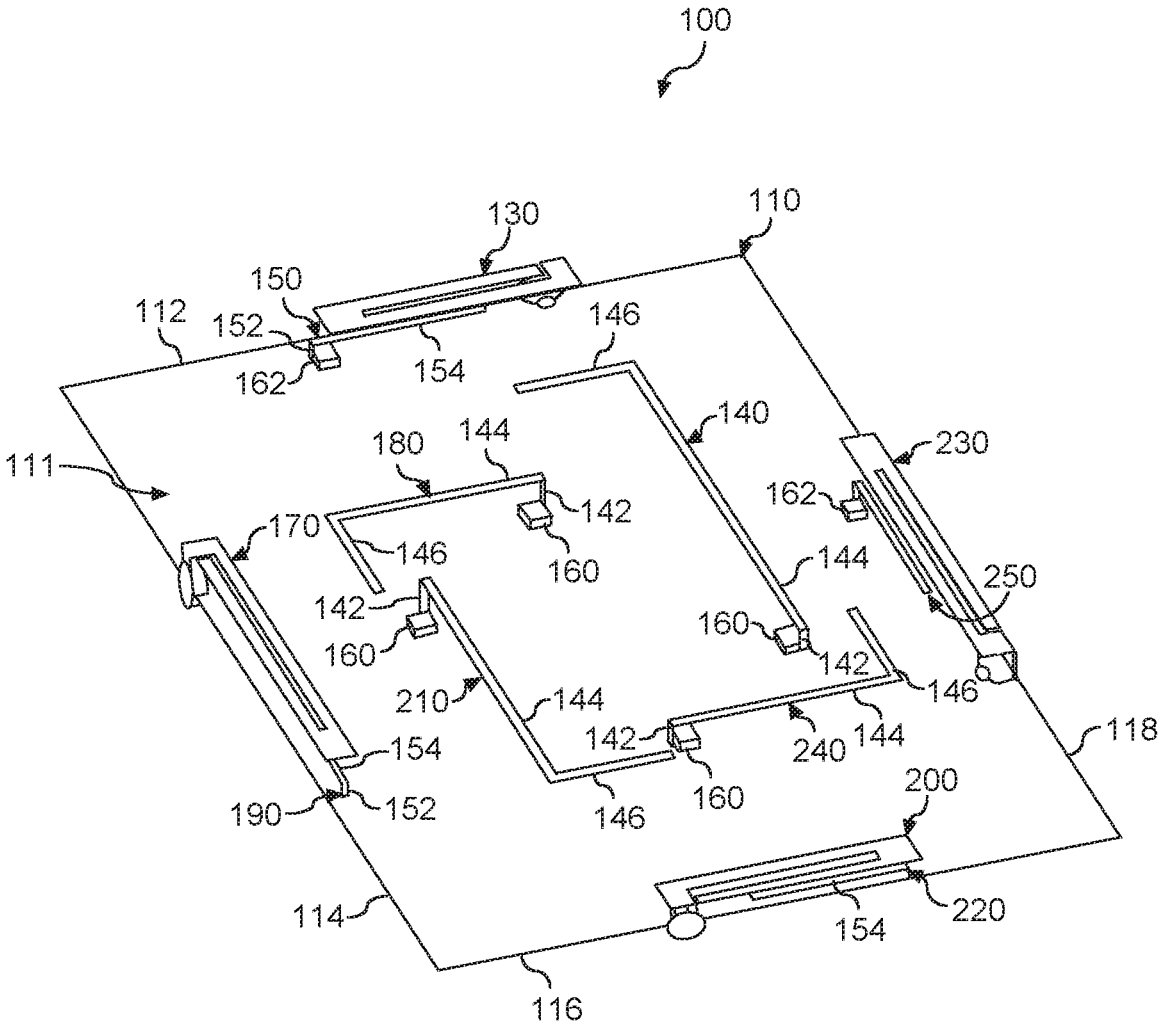
FIG. 2 depicts a multi-mode antenna system according to example embodiments of the present disclosure.

Referring now to FIGS. 1 and 2 in combination, the first modal antenna 120 can be disposed on a ground plane 111 of the circuit board 110. As shown, the first modal antenna 120 can include a driven element 130 and at least one parasitic element. In some implementations, the at least one parasitic element can include a first parasitic element 140 and a second parasitic element 150. As shown, the first parasitic element 140 can be positioned outside an antenna volume defined between the circuit board 110 (e.g., the ground plane 111) and the driven element 130. The first parasitic element 140 can include a first linear portion 142 coupled to the ground plane 111. The first parasitic element 140 can further include a second linear portion 144 extending from the first linear portion 142. The second linear portion can be spaced apart from the ground plane 111 and substantially perpendicular to the first linear portion 142. The first parasitic element 140 can further include a third linear portion 146 extending from the second linear portion 144. The third linear portion 146 can be spaced apart from the ground plane 111 and substantially perpendicular to the second linear portion 144.

The first modal antenna 120 can include a first active element 160 configured to alter a reactance of the first parasitic element 140 by way of a variable reactance or shorting to ground. It should also be appreciated that the first active element 160 can include at least one of a tunable capacitor, MEMS device, tunable inductor, switch (e.g., single pole quadruple throw), a tunable phase shifter, a field-effect transistor, or a diode.

In some implementations, the first active element 160 can be a single pole quadruple pole switching device configurable in a plurality of states (e.g., four states). When the first active element 160 is configured in a first state, the first parasitic element 140 can be coupled to a capacitor (e.g., passive capacitor, tunable capacitor). In this manner, the first parasitic element 140 can be coupled to a capacitive load. Conversely, the first parasitic element 140 can be coupled to an inductor when the first active element 160 is configured in a second state. In this manner, the first parasitic element 140 can be coupled to an inductive load. When the first active element 160 is configured in a third state, the first parasitic element 140 can be coupled to an electrical ground to create a short circuit. Alternatively, the first parasitic element 140 can be decoupled from the electrical ground to create an open circuit when the first active element 160 is configured in a fourth state. In this manner, the first modal antenna 120 can be configured in at least four different modes. Furthermore, each of the four different states can have a distinctive radiation pattern. It should be appreciated, however, that the first active element 160 can be configured to switch between any suitable number of states.

The second parasitic element 150 of the first modal antenna 120 can be disposed within the antenna volume defined between the circuit board 110 (e.g., ground plane 111) and the driven element 130. As shown, the second parasitic element 150 can include a first linear portion 152 coupled to the ground plane 111. The second parasitic element 150 can further include a second linear portion 154 extending from the first linear portion 152. The second linear portion 154 can be spaced apart from the ground plane 111 and substantially perpendicular to the first linear portion 152.

The first modal antenna 120 can include a second active element 162 operatively coupled to the second parasitic element 150. The second active element 162 can be configured to alter a reactance of the second parasitic element 150 by way of a variable reactance or shorting to ground. It should be appreciated that altering the reactance of the second parasitic element 150 can result in a frequency shift of the first modal antenna 120. It should also be appreciated that the second active element 162 can include at least one of a tunable capacitor, MEMS device, tunable inductor, switch, a tunable phase shifter, a field-effect transistor, or a diode.

The second modal antenna 122 can include a driven element 170 and at least one parasitic element. In some implementations, the at least one parasitic element can include a first parasitic element 180 and a second parasitic element 190. The first parasitic element 180 of the second modal antenna 122 can be substantially similar to the first parasitic element 140 of the first modal antenna 120. Likewise, the second parasitic element 190 of the second modal antenna 122 can be substantially similar to the second parasitic element 150 of the first modal antenna 120. It should also be appreciated that the second modal antenna 122 can include active elements similar to the first active element 160 and second active element 162 of the first modal antenna 120.

The third modal antenna 124 can include a driven element 200 and at least one parasitic element. In some implementations, the at least one parasitic element can include a first parasitic element 210 and a second parasitic element 220. The first parasitic element 210 of the third modal antenna 124 can be substantially similar to the first parasitic element 140 of the first modal antenna 120. Likewise, the second parasitic element 220 of the third modal antenna 124 can be substantially similar to the second parasitic element 150 of the first modal antenna 120. It should also be appreciated that the third modal antenna 124 can include active elements similar to the first active element 160 and second active element 162 of the first modal antenna 120.

The fourth modal antenna 126 can include a driven element 230 and at least one parasitic element. In some implementations, the at least one parasitic element can include a first parasitic element 240 and a second parasitic element 250. The first parasitic element 240 of the fourth modal antenna 126 can be substantially similar to the first parasitic element 240 of the first modal antenna 120. Likewise, the second parasitic element 250 of the fourth modal antenna 126 can be substantially similar to the second parasitic element 150 of the first modal antenna 120. It should also be appreciated that the fourth modal antenna 126 can include active elements similar to the first active element 160 and second active element 162 of the first modal antenna 120.

In some implementations, the first modal antenna 120 can be configured in one or more additional modes via the first active element 160 of at least one other modal antenna (e.g., second modal antenna 122, third modal antenna 124, fourth modal antenna 125). For instance, the active element 160 of the second modal antenna 122 can be controlled to adjust a reactance of the first parasitic element 180 of the second modal antenna 122 to affect a radiation pattern of the first modal antenna 120. More specifically, the reactance of the first parasitic element 180 of the second modal antenna 122 can affect the radiation pattern of the first modal antenna 120 such that additional modes of the first modal antenna are provided. In some implementations, 60 additional modes of the first modal antenna 120 can be provided. It should be appreciated that additional modes can be provided for the second modal antenna 122, third modal antenna 124 and fourth modal antenna 126. In this manner, each of the modal antennas of the multi-mode antenna system 100 can, in some implementations, be configured in 64 different modes. As such, the multi-mode antenna system 100 of FIG. 2 can, in some implementations, be configurable in 256 different modes.

In some implementations, the driven element of each modal antenna can be positioned adjacent a corresponding edge of the ground plane 111. For instance, the driven element 130 of the first modal antenna 120 can be positioned adjacent a first edge 112 of the ground plane 111. In addition, the driven element 170 of the second modal antenna 122 can be positioned adjacent a second edge 114 of the ground plane 111. Furthermore, the driven element 200 of the third modal antenna 124 can be positioned adjacent a third edge 116 of the ground plane 111. Still further, the driven element 230 of the fourth modal antenna 126 can be positioned adjacent a fourth edge 118 of the ground plane 111. In some implementations, the ground plane 111 of the circuit board 110 can have a square shape.

In some implementations, the driven elements of the multi-mode antenna system 100 can be rotated relative to one another along a plane that is substantially parallel to the ground plane 111. For instance, the driven element 170 of the second modal antenna 122 can be rotated in the plane by about ninety degrees relative to the driven element 130 of the first modal antenna 120. Furthermore, the driven element 200 of the third modal antenna 124 can be rotated in the plane by about ninety degrees relative to the driven element 170 of the second modal antenna 122. Still further, the driven element 230 of the fourth modal antenna 126 can be rotated in the plane by about ninety degrees relative to the driven element 200 of the third modal antenna 124.

In some implementations, the parasitic antenna elements included in the multi-mode antenna system 100 can be rotated relative to one another in a plane that is substantially parallel to the ground plane 111. For instance, the first parasitic element 180 of the second modal antenna 122 can be rotated in the plane by about ninety degrees relative to the first parasitic element 140 of the first modal antenna 120. Furthermore, the first parasitic element 210 of the third modal antenna 124 can be rotated in the plane by about ninety degrees relative to the first parasitic element 180 of the second modal antenna 122. Still further, the first parasitic element 240 of the fourth modal antenna 126 can be rotated in the plane by about ninety degrees relative to the first parasitic element 210 of the third modal antenna 124.

Alternatively or additionally, the second parasitic elements included in each modal antenna can be rotated relative to one another in a plane that is substantially parallel to the ground plane 11. For instance, the second parasitic element 190 of the second modal antenna 122 can be rotated in the plane by about ninety degrees relative to the second parasitic element 150 of the first modal antenna 120. Furthermore, the second parasitic element 220 of the third modal antenna 124 can be rotated in the plane by about ninety degrees relative to the second parasitic element 190 of the second modal antenna 122. Still further, the second parasitic element 250 of the fourth modal antenna 126 can be rotated in the plane by about ninety degrees relative to the second parasitic element 220 of the third modal antenna 124.

Figure 3:
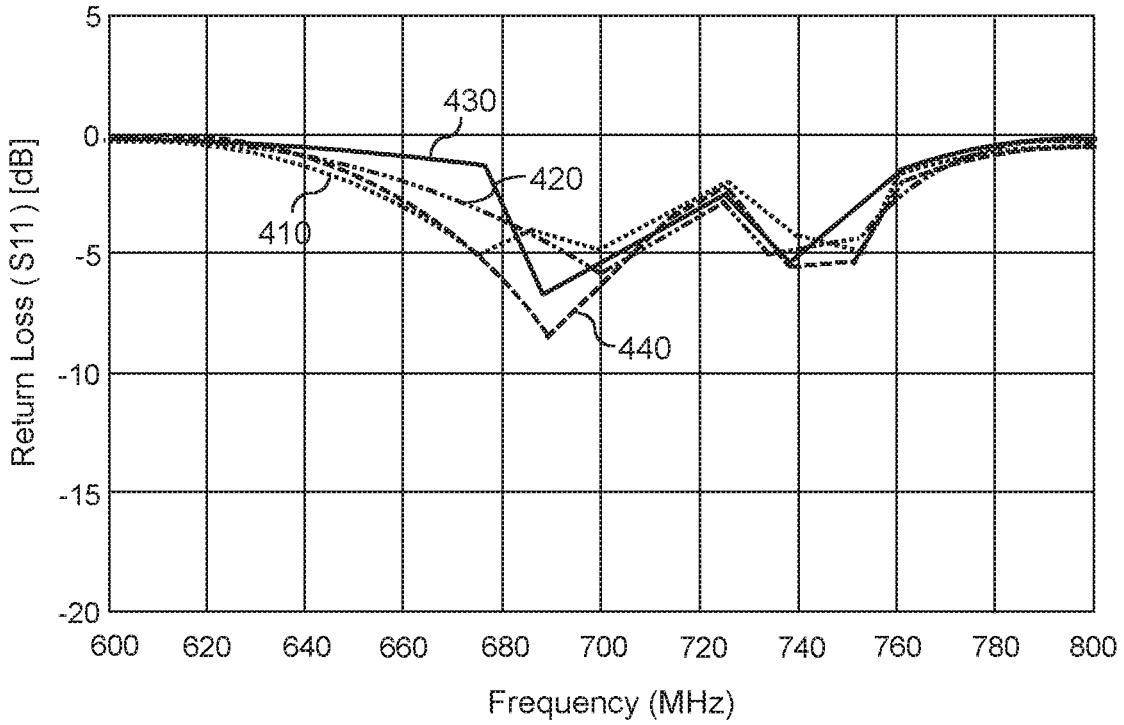
FIG. 3 depicts a graphical representation of return loss associated with a multi-mode antenna system according to example embodiments of the present disclosure.

Referring now to FIG. 3, a graphical representation of return loss of the multi-mode antenna system 100 (FIG. 2) is provided according to example embodiments of the present disclosure. As shown, the graph illustrates return loss (denoted along the vertical axis in decibels) of the antenna system as a function of frequency (denoted along the horizontal axis in megahertz). More specifically, the graph illustrates loss of the antenna system over a range of frequencies that spans from 600 megahertz (MHz) to 800 MHz. As shown, curve 410 depicts the return loss associated with a first operating mode of the plurality of operating modes over the range of frequencies. Curve 420 depicts the return loss associated with a second operating mode of the plurality of operating modes over the range of frequencies. Curve 430 depicts the return loss associated with a third operating mode of the plurality of operating modes over the range of frequencies. Curve 440 depicts the return loss associated with a fourth operating mode of the plurality of operating modes over the range of frequencies.

Figure 4:
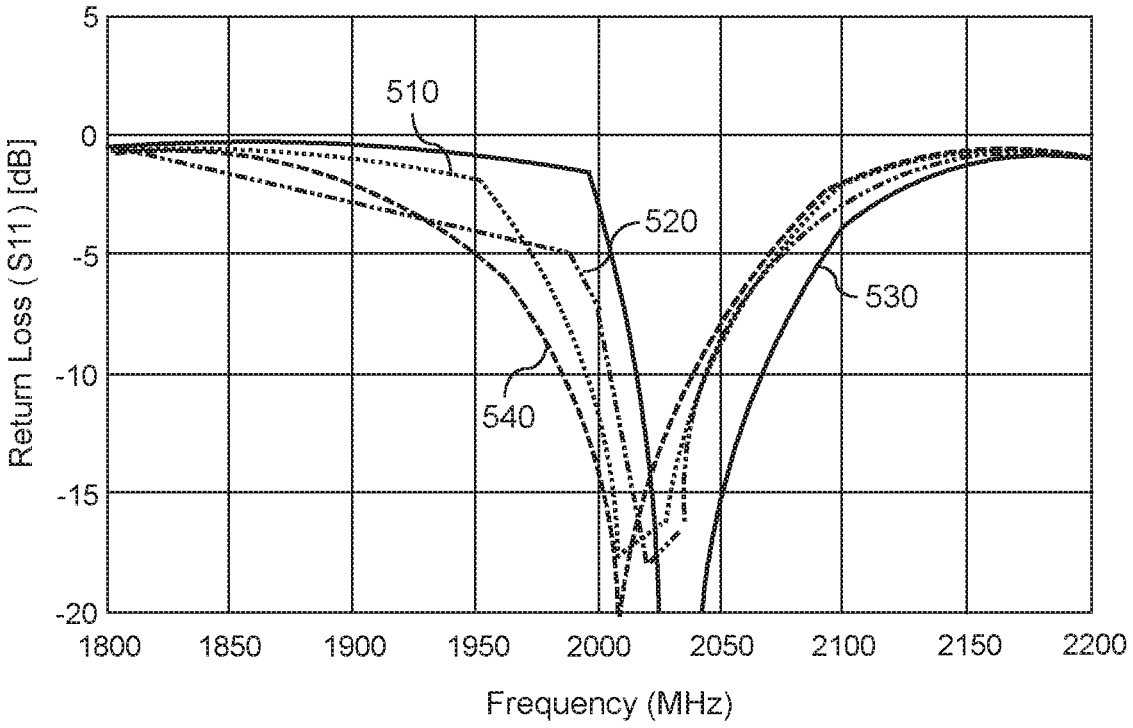
FIG. 4 depicts another graphical representation of return loss associated with a multi-mode antenna system according to example embodiments of the present disclosure.

Referring now to FIG. 4, a graphical representation of return loss of the multi-mode antenna system 100 (FIG. 2) is provided according to example embodiments of the present disclosure. As shown, the graph illustrates return loss (denoted along the vertical axis in decibels) of the antenna system as a function of frequency (denoted along the horizontal axis in megahertz). More specifically, the graph illustrates loss of the antenna system over a range of frequencies that spans from 1800 megahertz (MHz) to 2200 MHz. As shown, curve 510 depicts the return loss associated with a first operating mode of the plurality of operating modes over the range of frequencies. Curve 520 depicts the return loss associated with a second operating mode of the plurality of operating modes over the range of frequencies. Curve 530 depicts the return loss associated with a third operating mode of the plurality of operating modes over the range of frequencies. Curve 540 depicts the return loss associated with a fourth operating mode of the plurality of operating modes over the range of frequencies.

Figure 5:
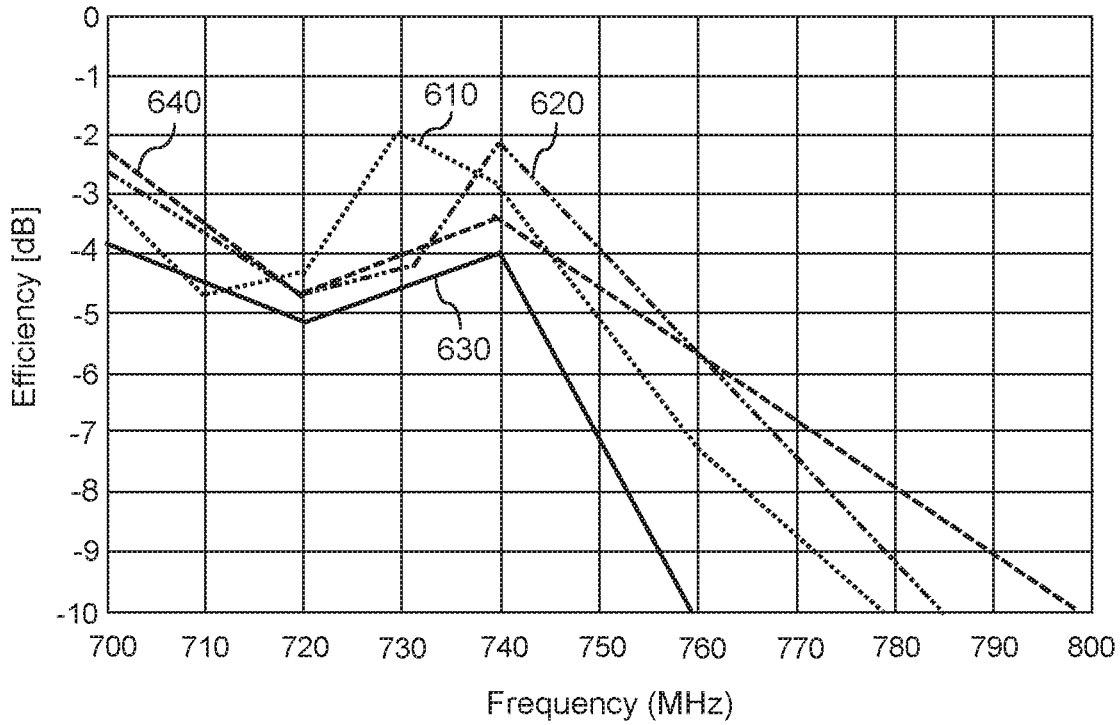
FIG. 5 depicts a graphical representation of efficiency of a multi-mode antenna system according to example embodiments of the present disclosure.

Referring now to FIG. 5, another graphical representation of efficiency of the multi-mode antenna system 100 (FIG. 2) is provided according to example embodiments of the present disclosure. As shown, the graph illustrates efficiency (denoted along the vertical axis as a percentage) of the antenna system as a function of frequency (denoted along the horizontal axis megahertz). More specifically, the graph illustrates the efficiency of the antenna system over a range of frequencies that spans from 700 MHz to 800 MHz. It should be appreciated that the efficiency of the multi-mode antenna represents a ratio of power delivered to the antenna relative to the power radiated by the antenna. As shown, curve 610 depicts the efficiency of the multi-mode antenna system in a first operating mode of the plurality of operating modes over the range of frequencies. Curve 620 depicts the efficiency of the multi-mode antenna system in a second operating mode of the plurality of operating modes over the range of frequencies. Curve 630 depicts the efficiency of the multi-mode antenna system in a third operating mode of the plurality of operating modes over the range of frequencies. Curve 640 depicts the efficiency of the multi-mode antenna system in a fourth operating mode of the plurality of operating modes over the range of frequencies.

Figure 6:
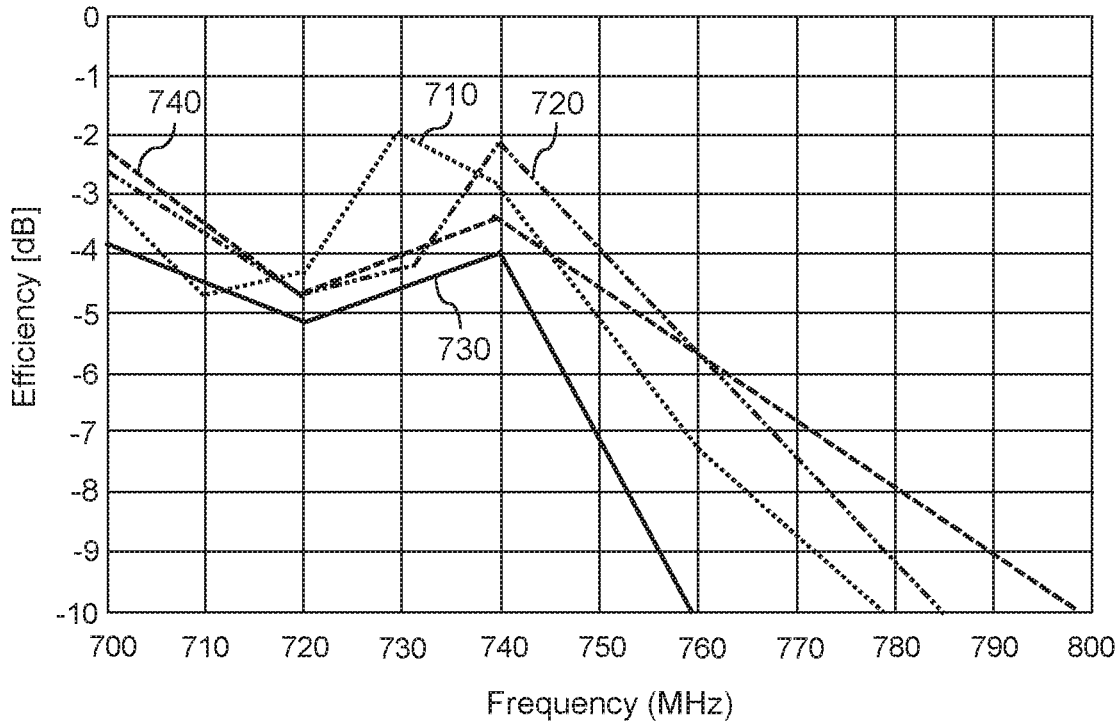
FIG. 6 depicts another graphical representation of efficiency of a multi-mode antenna system according to example embodiments of the present disclosure.

Referring now to FIG. 6, another graphical representation of efficiency of the multi-mode antenna system 100 (FIG. 2) is provided according to example embodiments of the present disclosure. As shown, the graph illustrates efficiency (denoted along the vertical axis as a percentage) of the antenna system as a function of frequency (denoted along the horizontal axis megahertz). More specifically, the graph illustrates the efficiency of the antenna system over a range of frequencies that spans from 1800 MHz to 2200 MHz. It should be appreciated that the efficiency of the multi-mode antenna represents a ratio of power delivered to the antenna relative to the power radiated by the antenna. As shown, curve 710 depicts the efficiency of the multi-mode antenna system in a first operating mode of the plurality of operating modes over the range of frequencies. Curve 720 depicts the efficiency of the multi-mode antenna system in a second operating mode of the plurality of operating modes over the range of frequencies. Curve 730 depicts the efficiency of the multi-mode antenna system in a third operating mode of the plurality of operating modes over the range of frequencies. Curve 740 depicts the efficiency of the multi-mode antenna system in a fourth operating mode of the plurality of operating modes over the range of frequencies.

Figure 7:
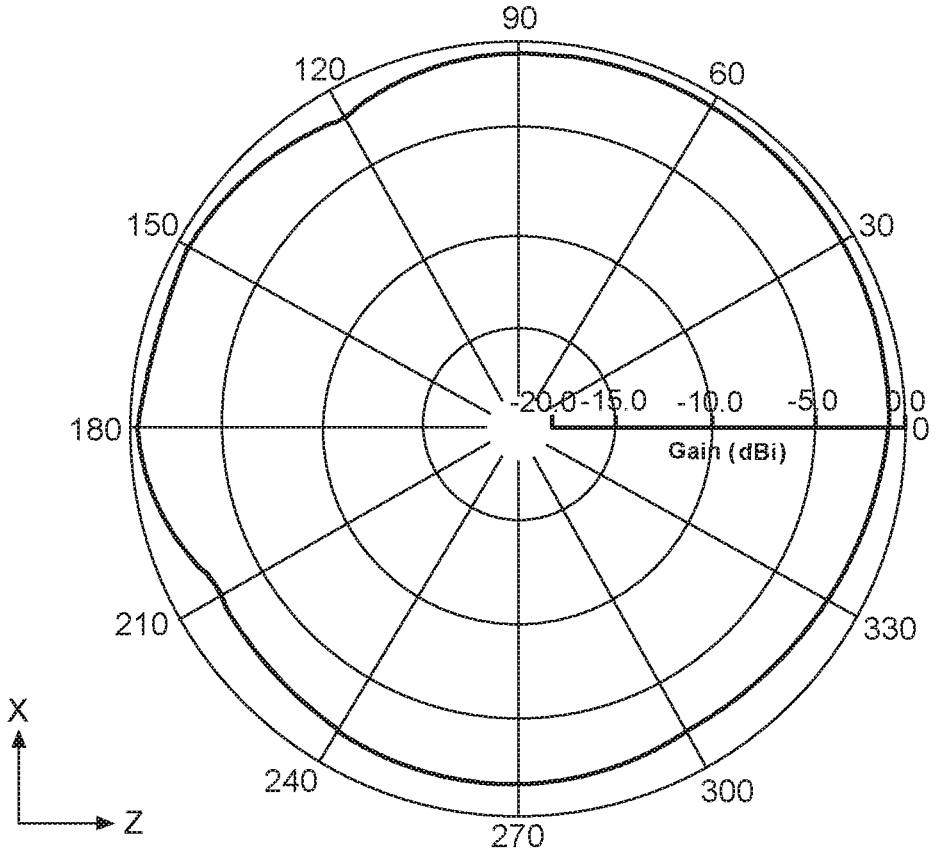
FIG. 7 depicts a graphical representation of an azimuthal radiation pattern associated with a multi-mode antenna system when tuned to a first frequency according to example embodiments of the present disclosure.

FIG. 7 depicts a graphical representation of an azimuthal plane radiation pattern associated with the multi-mode antenna system 100 (FIG. 2) according to example embodiments of the present disclosure. More specifically, the graph depicts the azimuthal radiation pattern associated with the multi-mode antenna system 100 (FIGS. 1 and 2) when tuned to about 720 MHz. As shown, the radiation pattern is nearly isotropic in the azimuthal plane when the multi-mode antenna system 100 is tuned to about 720 MHz.

Figure 8:
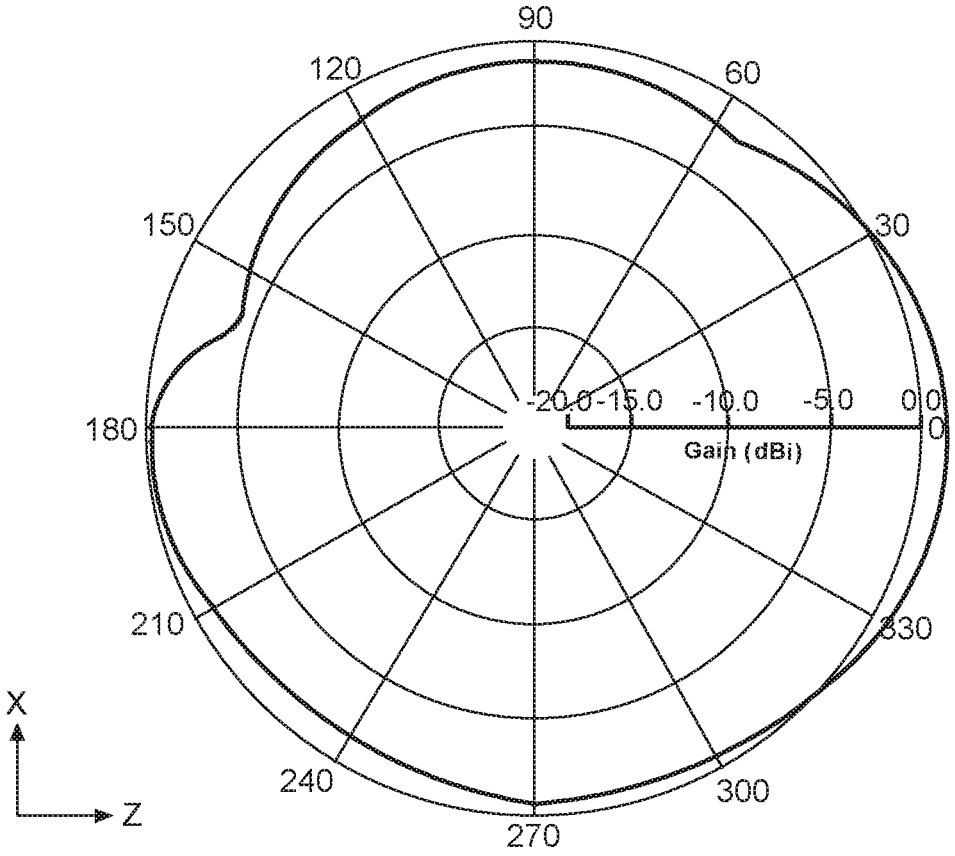
FIG. 8 depicts a graphical representation of an elevation radiation pattern associated with a multi-mode antenna system when tuned to a first frequency according to example embodiments of the present disclosure.
Figure 9:
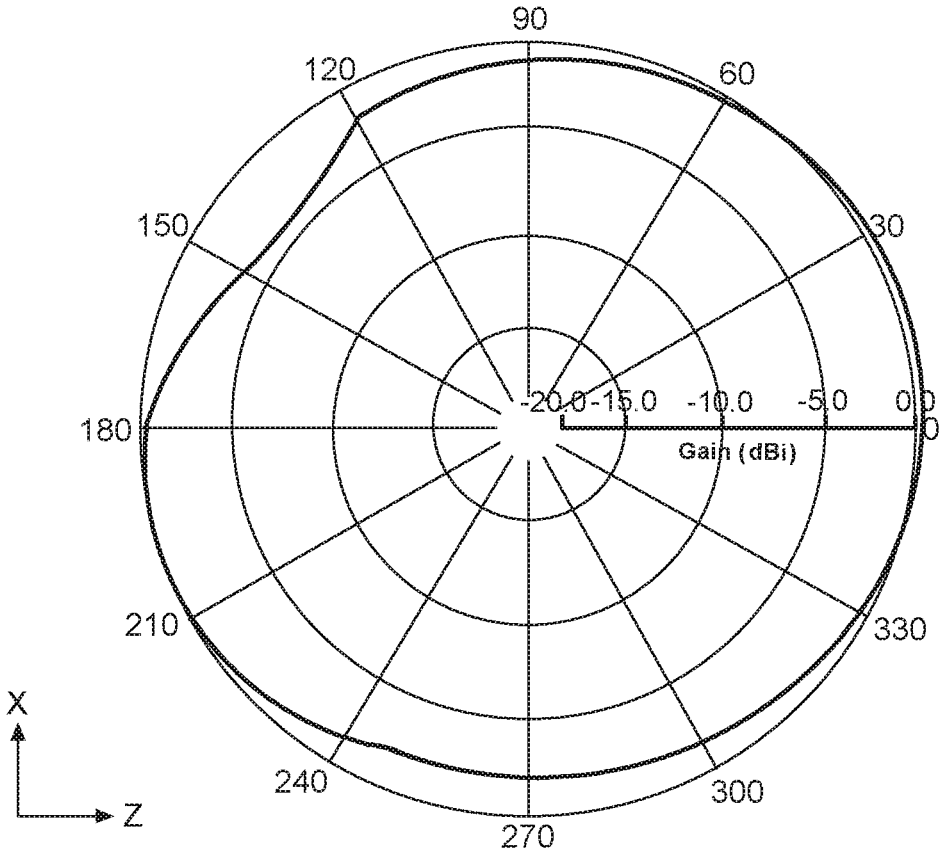
FIG. 9 depicts another graphical representation of an elevation radiation pattern associated with a multi-mode antenna system when tuned to the first frequency according to example embodiments of the present disclosure.

FIGS. 8 and 9 depict a graphical representation of an elevation plane radiation pattern associated with the multi-mode antenna system 100 according to example embodiment of the present disclosure. More specifically, the graph depicts the elevation radiation pattern associated with the multi-mode antenna system 100 when tuned to about 720 MHz. As shown, the radiation pattern is nearly isotropic in the elevation plane when the multi-mode antenna system 100 is tuned to about 720 MHz.

Figure 10:
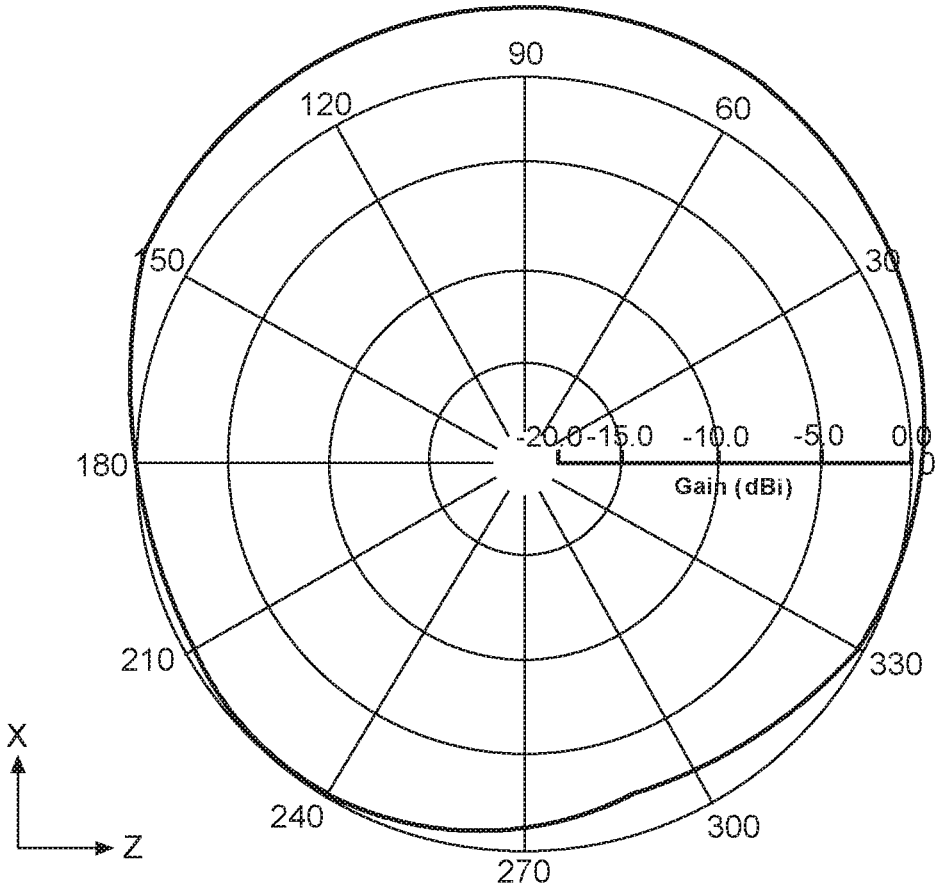
FIG. 10 depicts a graphical representation of an azimuthal radiation pattern associated with a multi-mode antenna system when tuned to a first frequency according to example embodiments of the present disclosure.

FIG. 10 depicts a graphical representation of an azimuthal plane radiation pattern associated with the multi-mode antenna system 100 (FIGS. 1 and 2) according to example embodiments of the present disclosure. More specifically, the graph depicts the azimuthal radiation pattern associated with the multi-mode antenna system 100 when tuned to about 2020 MHz. As shown, the radiation pattern is nearly isotropic in the azimuthal plane when the multi-mode antenna system 100 is tuned to about 2020 MHz.

Figure 11:
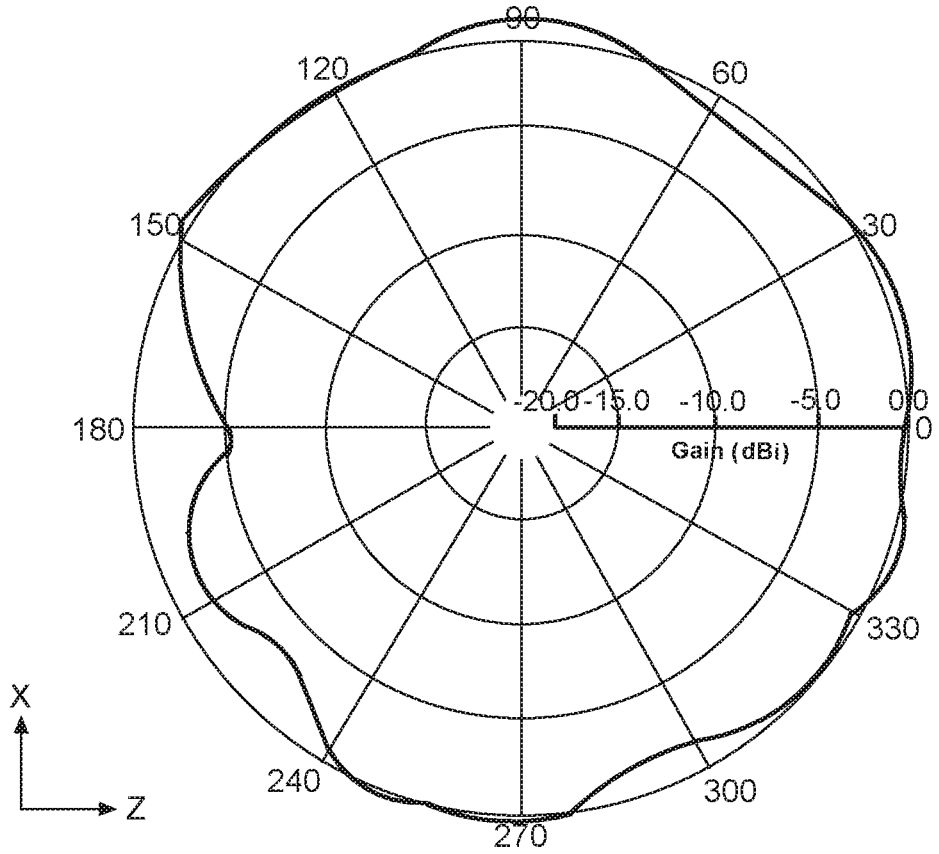
FIG. 11 depicts a graphical representation of an elevation radiation pattern associated with a multi-mode antenna system when tuned to a first frequency according to example embodiments of the present disclosure.
Figure 12:
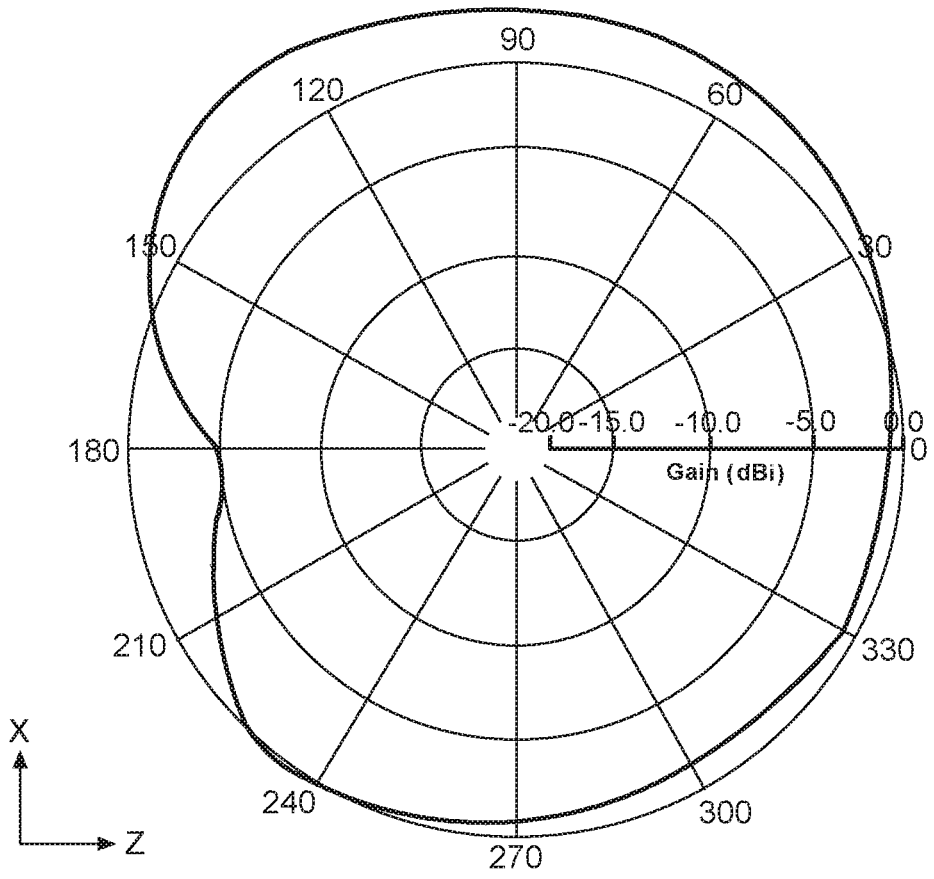
FIG. 12 depicts another graphical representation of an elevation radiation pattern associated with a multi-mode antenna system when tuned to the first frequency according to example embodiments of the present disclosure.

FIGS. 11 and 12 depict a graphical representation of an elevation plane radiation pattern associated with the multi-mode antenna system 100 according to example embodiment of the present disclosure. More specifically, the graph depicts the elevation radiation pattern associated with the multi-mode antenna system 100 when tuned to about 2020 MHz. As shown, the radiation pattern is nearly isotropic in the elevation plane when the multi-mode antenna system 100 is tuned to about 2020 MHz.

Figure 13:
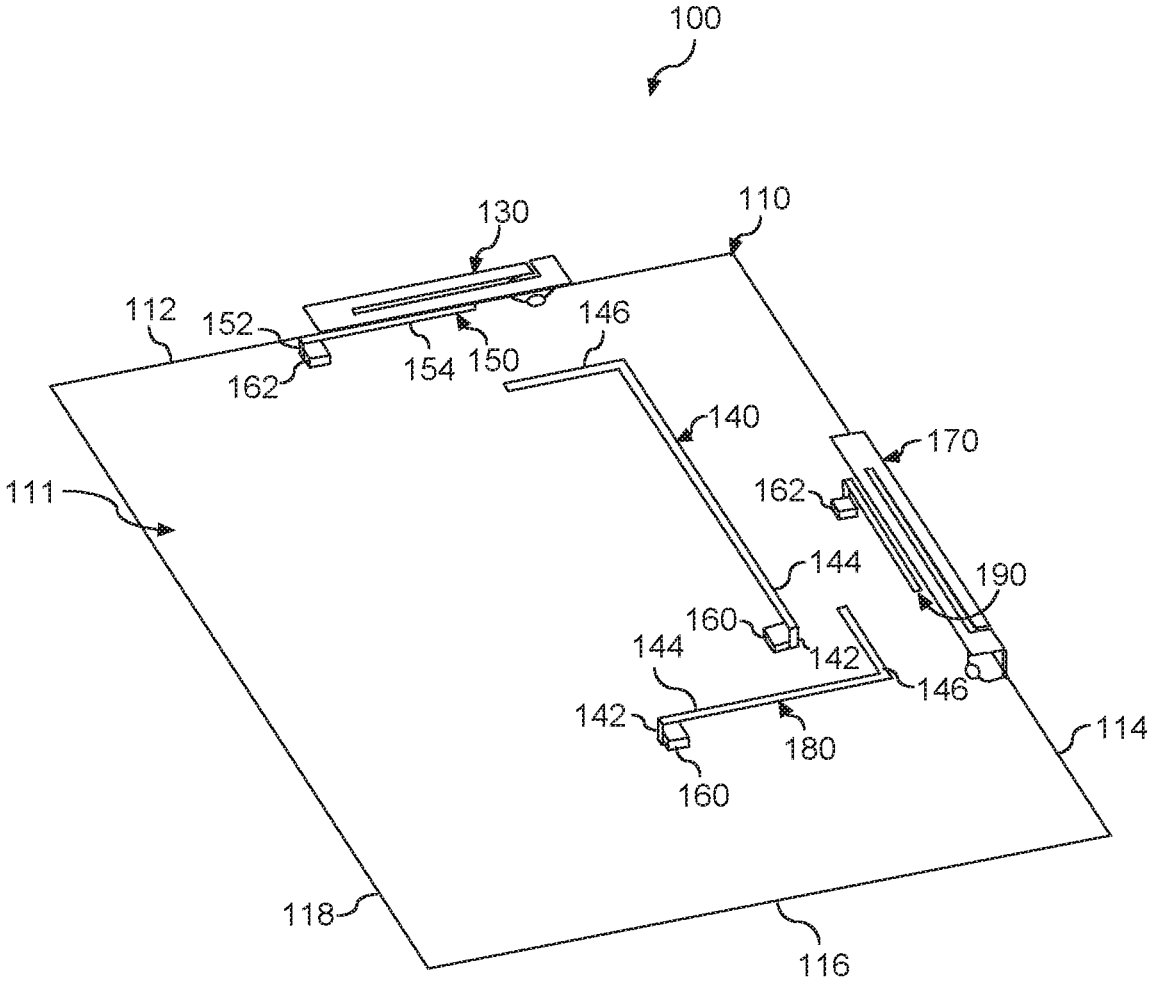
FIG. 13 depicts another example embodiment of a multi-mode antenna system according to example embodiments of the present disclosure.

Referring now to FIG. 13, another embodiment of the multi-mode antenna system 100 is provided according to example embodiments of the present disclosure. The multi-mode antenna system 100 can include the same or similar components as the multi-mode antenna system 100 discussed above with reference to FIGS. 1 and 2. For instance, the multi-mode antenna system 100 of FIG. 13 can include the first modal antenna 120 and the second modal antenna 112. However, the multi-mode antenna system 100 of FIG. 13 includes only two modal antennas.

As shown, the driven element 130 of the first modal antenna 120 can be positioned adjacent the first edge 112 of the ground plane 111. Furthermore, the driven element 170 of the second modal antenna 122 can be positioned adjacent the second edge 114 of the ground plane 111. As shown, the second edge 114 of the ground plane 111 can be substantially perpendicular to the first edge 112 of the ground plane 111. Additionally, the driven element 170 of the second modal antenna 122 can be rotated relative to the driven element 130 of the first modal antenna in a plane that is substantially parallel to the ground plane 111. For instance, the driven element 170 of the second modal antenna 122 can be rotated in the plane by about 90 degrees relative to the driven element 130 of the first modal antenna. It should be appreciated, however, that the driven element 170 of the second modal antenna 122 can be rotated in the plane by any suitable amount.

As shown, the first parasitic element 180 of the second modal antenna 122 can be rotated in the plane relative to the first parasitic element 140 of the first modal antenna 120. Furthermore, the reactance of the first parasitic element 180 of the second modal antenna 122 can be adjusted to affect the radiation pattern of the first modal antenna 120. Likewise, the reactance of the first parasitic element 140 of the first modal antenna can be adjusted to affect the radiation pattern of the second modal antenna 122. In this manner, additional modes can, as discussed above, be generated for both the first modal antenna 120 and the second modal antenna 122 to improve the coverage of the multi-mode antenna system 100. More specifically, the additional modes can allow the multi-mode antenna system 100 to provide near isotropic (e.g., omnidirectional) coverage over a wider range of frequencies. Furthermore, when the multi-mode antenna system 100 is used in diversity applications, the diversity gain of the multi-mode antenna system 100 can be increased.

Figure 14:
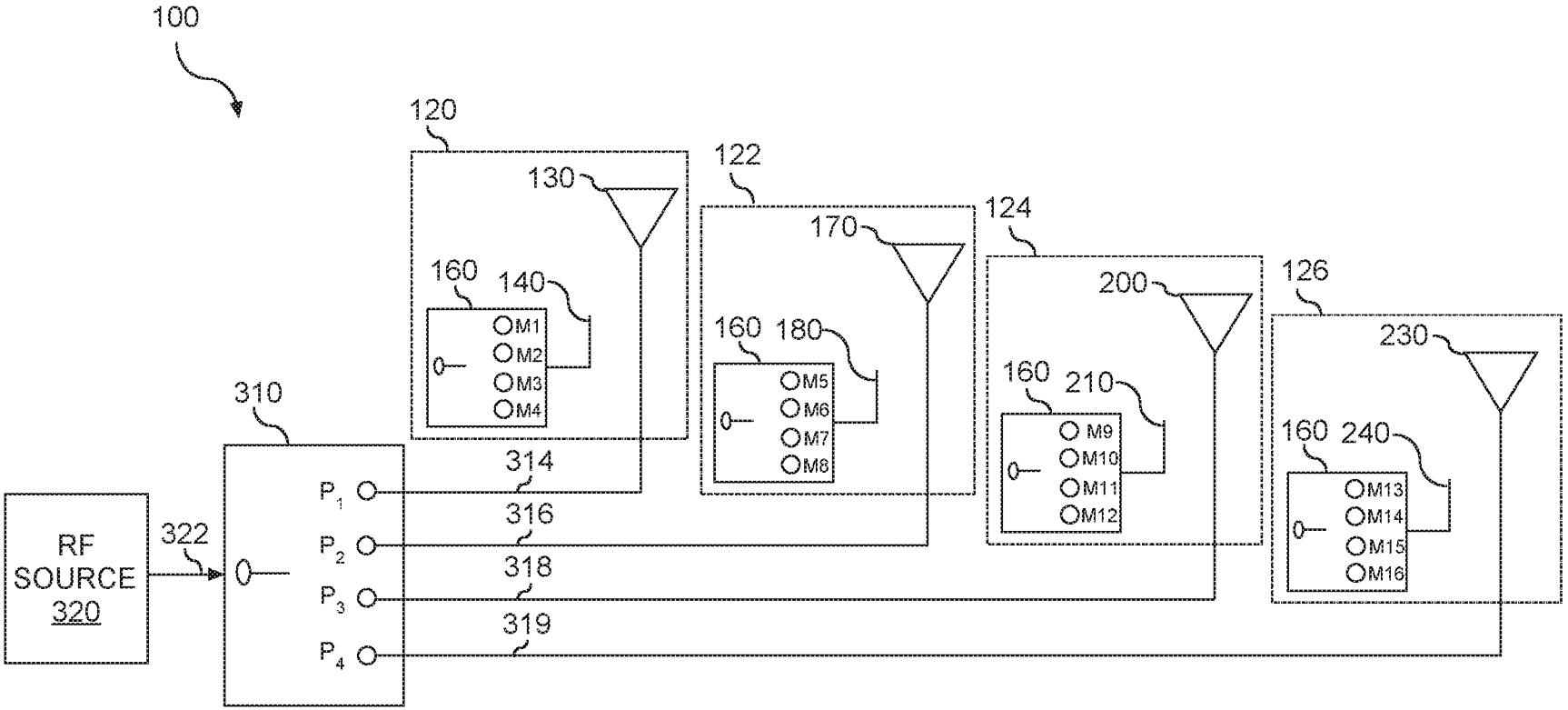
FIG. 14 depicts yet another example embodiment of a multi-mode antenna system according to example embodiments of the present disclosure.

Referring now to FIG. 14, the multi-mode antenna system 100 can be a single input single output (SISO) antenna system according to example embodiments of the present disclosure. As shown, the multi-mode antenna system 100 can include a switching device 310 configurable in a plurality of states. For example, in some implementations the switching device 310 can be a single pole quadruple throw switch configurable in four states (e.g. P1, P2, P3, and P4). It should be appreciated, however, that the switching device 310 can be configured in any number of states. It should also be appreciated that the switching device 310 can include any suitable type of switching device configurable in a plurality of states. For instance, in some implementations, the switching device 310 can include one or more transistors (e.g., MOSFETS, IGBTs, etc.). As will be discussed below in more detail, a controller 400 (FIG. 15) communicatively coupled to the switching device 310 can be configured to control operation of the switching device 310 to selectively couple a corresponding modal antenna 120, 122, 124, 126 of the antenna system 100 to an RF source 320 configured to provide a RF signal 322.

When the switching device 310 is in a first state P1, the switching device 310 is coupled to the first modal antenna 120 via one or more conductors 314 (e.g., wires). In this manner, the RF signal 322 can be provided to the first modal antenna 120 via the switching device 310. More specifically, the RF signal 322 can be provided to the driven element 130 of the first modal antenna 120. As discussed above, the first active element 160 of the first modal antenna 120 can adjust the reactance of the first parasitic element 140 to configure the driven element 130 in one of a plurality of different modes. Furthermore, each of the modes can have a distinct radiation pattern. In this manner, the first active element 160 can adjust the reactance of the first parasitic element 140 to alter the radiation pattern of the driven element 130. As shown, in some implementations, the first active element 160 can adjust the reactance of the first parasitic element 140 to configure the driven element 130 in one of four different modes (e.g., M1, M2, M3, and M4). It should be appreciated, however, that the driven element 130 of the first modal antenna 120 can be configured in any suitable number of different modes via adjustments to the reactance of the first parasitic element 140.

When the switching device 310 is in a second state P2, the switching device 310 is coupled to the second modal antenna 122 via one or more conductors 316 (e.g., wires). In this manner, the RF signal 322 can be provided to the second modal antenna 122 via the switching device 310. More specifically, the RF signal 322 can be provided to the driven element 170 of the second modal antenna 122. As discussed above, the first active element 160 of the second modal antenna 122 can adjust the reactance of the first parasitic element 180 to configure the driven element 170 in one of a plurality of different modes. Furthermore, each of the modes can have a distinct radiation pattern. In this manner, the first active element 160 can adjust the reactance of the first parasitic element 180 to alter the radiation pattern of the driven element 170. As shown, in some implementations, the first active element 160 can adjust the reactance of the first parasitic element 180 to configure the driven element 170 in one of four different modes (e.g., M5, M6, M7, and M8). It should be appreciated, however, that the driven element 170 of the second modal antenna 122 can be configured in any suitable number of different modes via adjustments to the reactance of the first parasitic element 180.

When the switching device 310 is in a third state P3, the switching device 310 is coupled to the third modal antenna 124 via one or more conductors 318 (e.g., wires). In this manner, the RF signal 322 can be provided to the third modal antenna 124 via the switching device 310. More specifically, the RF signal 322 can be provided to the driven element 200 of the third modal antenna 124. As discussed above, the first active element 160 of the third modal antenna 124 can adjust the reactance of the first parasitic element 210 to configure the driven element 200 in one of a plurality of different modes. Furthermore, each of the modes can have a distinct radiation pattern. In this manner, the first active element 160 can adjust the reactance of the first parasitic element 210 to alter the radiation pattern of the driven element 200. As shown, in some implementations, the first active element 160 can adjust the reactance of the first parasitic element 210 to configure the driven element 200 in one of four different modes (e.g., M9, M10, M11, and M12). It should be appreciated, however, that the driven element 200 of the third modal antenna 124 can be configured in any suitable number of different modes via adjustments to the reactance of the first parasitic element 210.

When the switching device 310 is in a fourth state P4, the switching device 310 is coupled to the fourth modal antenna 126 via one or more conductors 319 (e.g., wires). In this manner, the RF signal 322 can be provided to the fourth modal antenna 126 via the switching device 310. More specifically, the RF signal 322 can be provided to the driven element 230 of the fourth modal antenna 126. As discussed above, the first active element 160 of the fourth modal antenna 126 can adjust the reactance of the first parasitic element 240 to configure the driven element 230 in one of a plurality of different modes. Furthermore, each of the modes can have a distinct radiation pattern. In this manner, the first active element 160 can adjust the reactance of the first parasitic element 240 to alter the radiation pattern of the driven element 230. As shown, in some implementations, the first active element 160 can adjust the reactance of the first parasitic element 240 to configure the driven element 230 in one of four different modes (e.g., M13, M14, M15, and M16). It should be appreciated, however, that the driven element 230 of the fourth modal antenna 126 can be configured in any suitable number of different modes via adjustments to the reactance of the first parasitic element 240.

As shown, the antenna system 100 of FIG. 14 can be configurable in sixteen different modes (e.g., M1, M2, M3, . . . M16). Furthermore, each of the sixteen different modes can have a distinct radiation pattern. It should be appreciated, however, that the antenna system 100 can be configurable in more or fewer modes. Furthermore, although the antenna system 100 is illustrated as a transmission (TX) circuit, it should be appreciated that the antenna system 100 can be implemented as a receive (RX) circuit in which one or more RF signals are received via one of the modal antennas 120, 122, 124, 126 and provided to one or more components (e.g., filter, processor, etc.) of the antenna system 100 via the switching device 310.

In some implementations, the antenna system 100 can be implemented as a phased array antenna system. For instance, the driven element 130, 170, 200, 230 of the modal antennas 120, 122, 124, 126 can be implemented as an antenna array. More specifically, a phase shifter (not shown) can be coupled between the RF source 320 and a corresponding driven element 130, 170, 200, 230. In this manner, the phase of RF signals emitted by each of the driven elements 130, 170, 200, 230 can be controlled such that the radiation pattern (e.g., beam) of the antenna system 100 can be steered in any given direction. Furthermore, the first parasitic element 140, 180, 210, 240 of each modal antenna 120, 122, 124, 126 can, as discussed above, adjust the radiation pattern of a corresponding driven element 130, 170, 200, 230 to further adjust the radiation pattern of the antenna system 100. In this manner, the gain of the array and beam forming capability can be improved.

Figure 15:
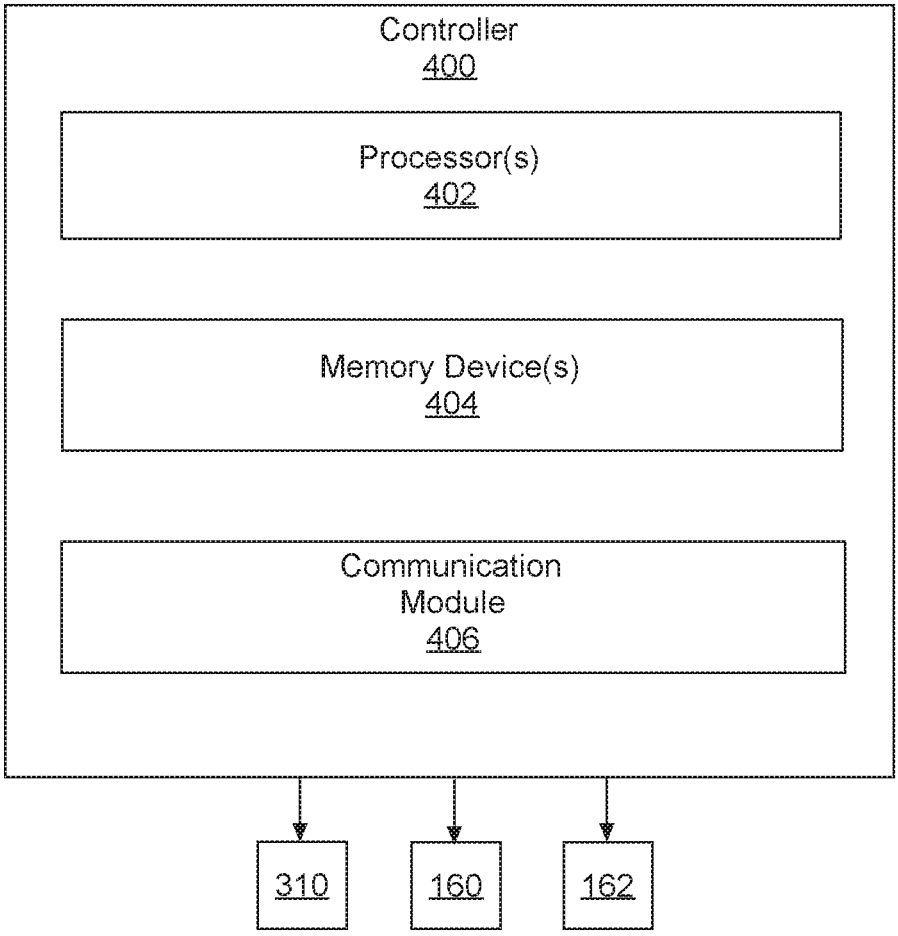
FIG. 15 depicts components of a controller according to example embodiments of the present disclosure.

Referring now to FIG. 15, a block diagram of components of the controller 400 is provided according to example embodiments of the present disclosure. As shown, the controller 400 can include one or more processors 402 configured to perform a variety of computer-implemented functions (e.g., performing the methods, steps, calculations and the like disclosed herein). As used herein, the term "processor" refers not only to integrated circuits referred to in the art as being included in a computer, but also refers to a controller, microcontroller, a microcomputer, a programmable logic controller (PLC), an application specific integrated circuit (ASIC), a Field Programmable Gate Array (FPGA), and other programmable circuits.

In some implementations, the controller 400 can include one or more memory devices 404. Examples of the memory device 404 can include computer-readable media including, but not limited to, non-transitory computer-readable media, such as RAM, ROM, hard drives, flash drives, or other suitable memory devices. The one or more memory devices 404 can store information accessible by the one or more processors 402, including computer-readable instructions that can be executed by the one or more processors 402. The computer-readable instructions can be any set of instructions that, when executed by the one or more processors 402, cause the one or more processors 402 to perform operations, such as controlling operation of the switching device 310 and the first parasitic element 160 of a corresponding modal antenna. The computer-readable instructions can be software written in any suitable programming language or can be implemented in hardware.

In some implementations, the controller 400 can include a communications module 406 to facilitate communication between the controller 400 and various components of the antenna system 100 (FIGS. 1, 13, and 14). For instance, the controller 400 can send control signals to control operation of the switching device 310. Alternatively or additionally, the controller 400 can send control signals to control operation of the first parasitic element 160 of each of the modal antennas 120, 122, 124, 126 (FIG. 14). Still further, in some implementations, the controller 400 can send control signals to control operation of the second parasitic element 162 of each of the modal antennas 120, 122, 124, 126.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A multi-mode antenna system comprising:

a circuit board comprising a ground plane;

a first modal antenna disposed on the ground plane, the first modal antenna configurable in one of a plurality of modes, each of the plurality of modes having a distinct radiation pattern, the first modal antenna comprising a driven element, a first parasitic element and a second parasitic element, the first parasitic element positioned outside of an antenna volume defined between the circuit board and the driven element, the second parasitic element positioned within the antenna volume, the first modal antenna further comprising a first active element and a second active element, the first active element configured to adjust a reactance of the first parasitic element to alter a radiation pattern associated with the driven element, the second active element configured to adjust a reactance of the second parasitic element; and a second modal antenna disposed on the ground plane, the second modal antenna configurable in one of a plurality of modes, each of the plurality of modes having a distinct radiation pattern, the second modal antenna comprising a driven element, a first parasitic element and a second parasitic element, the first parasitic element of the second modal antenna positioned outside of an antenna volume defined between the circuit board and the driven element of the second modal antenna, the second parasitic element of the second modal antenna positioned within the antenna volume defined between the circuit board and the driven element of the second modal antenna, the second modal antenna further comprising a first active element and a second active element, the first active element of the second modal antenna configured to adjust a reactance of the first parasitic element of the second modal antenna to alter a radiation pattern associated with the driven element of the second modal antenna, the second active element configured to adjust a reactance of the second parasitic element of the second modal antenna, wherein the first parasitic element of the second modal antenna is positioned such that controlling the first active element of the second modal antenna to adjust the reactance of the first parasitic element of the second modal antenna affects the radiation pattern associated with the first modal antenna, wherein the first parasitic element of the second modal antenna is rotated relative to the first parasitic element of the first modal antenna by about 90 degrees, and wherein the first parasitic element of the first modal antenna and the second modal antenna comprises:

a first linear portion coupled to the ground plane;

a second linear portion extending from the first linear portion such that the second linear portion is substantially perpendicular to the first linear portion, the second linear portion spaced apart from the ground plane; and a third linear portion extending from the second linear portion such that the third linear portion is substantially perpendicular to the second linear portion, the third linear portion spaced apart from the ground plane.

2. The multi-mode antenna system of claim 1, wherein:

the driven element of the first modal antenna is positioned adjacent a first edge of the ground plane; and the driven element of the second modal antenna is positioned adjacent a second edge of the ground plane that is substantially perpendicular to the first edge of the ground plane.

3. The multi-mode antenna system of claim 2, wherein the driven element of the second modal antenna is rotated relative to the driven element of the first modal antenna.

4. The multi-mode antenna system of claim 1, wherein the first parasitic element of at least one of the first modal antenna or the second modal antenna comprises:

a first linear portion coupled to the ground plane;

a second linear portion extending from the first linear portion, the second linear portion spaced apart from the ground plane and substantially perpendicular to the first linear portion; and a third linear portion extending from the second linear portion, the third linear portion spaced apart from the ground plane and substantially perpendicular to the second linear portion.

5. The multi-mode antenna system of claim 1, wherein the first parasitic element of the second modal antenna is rotated relative to the second parasitic element of the first modal antenna.

6. The multi-mode antenna system of claim 1, wherein the second parasitic element of the first modal antenna and the second modal antenna comprises:

a first linear portion coupled to the ground plane; and a second linear portion extending from the first linear portion of the second parasitic element, the second linear portion of the second parasitic element spaced apart from the ground plane and substantially perpendicular to the first linear portion of the second parasitic element.

7. The multi-mode antenna system of claim 1, further comprising:

a third modal antenna disposed on the ground plane, the third modal antenna configurable in one of a plurality of modes, each of the plurality of modes having a distinct radiation pattern, the third modal antenna comprising a driven element and at least one parasitic element, the third modal antenna further comprising an active element configured to adjust a reactance of the at least one parasitic antenna element of the third modal antenna to alter a radiation pattern associated with the driven element of the third modal antenna;

a fourth modal antenna disposed on the ground plane, the fourth modal antenna configurable in one of a plurality of modes, each of the plurality of modes having a distinct radiation pattern, the fourth modal antenna comprising a driven element and at least one parasitic element, the fourth modal antenna further comprising an active element configured to adjust a reactance of the at least one parasitic antenna element of the fourth modal antenna to alter a radiation pattern associated with the driven element of the fourth modal antenna.

8. The multi-mode antenna system of claim 7, wherein:

the driven element of the second modal antenna is rotated about ninety degrees relative to the driven element of the first modal antenna;

the driven element of the third modal antenna is rotated about ninety degrees relative to the driven element of the second modal antenna; and the driven element of the fourth modal antenna is rotated about ninety degrees relative to the driven element of the third modal antenna.

9. The multi-mode antenna system of claim 1, wherein the driven element includes an isolated magnetic dipole antenna element.

10. A multi-mode antenna system comprising:

a circuit board comprising a ground plane;

a first modal antenna disposed on the ground plane, the first modal antenna configurable in one of a plurality of modes, each of the plurality of modes having a distinct radiation pattern, the first modal antenna comprising a driven element and at least one parasitic element, the driven element positioned adjacent a first edge of the ground plane, the first modal antenna further comprising an active element configured to adjust a reactance of the at least one parasitic antenna element to alter a radiation pattern associated with the driven element;

a second modal antenna disposed on the ground plane, the second modal antenna configurable in one of a plurality of modes, each of the plurality of modes having a distinct radiation pattern, the second modal antenna comprising a driven element and at least one parasitic element, the driven element of the second modal antenna positioned adjacent a second edge of the ground plane, the second modal antenna further comprising an active element configured to adjust a reactance of the at least one parasitic antenna element of the second modal antenna to alter a radiation pattern associated with the driven element of the second modal antenna;

a third modal antenna disposed on the ground plane, the third modal antenna configurable in one of a plurality of modes, each of the plurality of modes having a distinct radiation pattern, the third modal antenna comprising a driven element and at least one parasitic element, the driven element of the third modal antenna positioned adjacent a third edge of the ground plane, the third modal antenna further comprising an active element configured to adjust a reactance of the at least one parasitic antenna element of the third modal antenna to alter a radiation pattern associated with the driven element of the third modal antenna;

a fourth modal antenna disposed on the ground plane, the fourth modal antenna configurable in one of a plurality of modes, each of the plurality of modes having a distinct radiation pattern, the fourth modal antenna comprising a driven element and at least one parasitic element, the driven element of the fourth modal antenna positioned adjacent a fourth edge of the ground plane, the fourth modal antenna further comprising an active element configured to adjust a reactance of the at least one parasitic antenna element of the fourth modal antenna to alter a radiation pattern associated with the driven element of the fourth modal antenna, wherein the at least one parasitic element of the second modal antenna is positioned such that controlling the active element of the second modal antenna to adjust the reactance of the at least one parasitic element of the second modal antenna affects the radiation pattern associated with at least one of the first modal antenna, the third modal antenna, or the fourth modal antenna.

11. The multi-mode antenna system of claim 10, wherein:

the driven element of the second modal antenna is rotated about ninety degrees relative to the driven element of the first modal antenna;

the driven element of the third modal antenna is rotated about ninety degrees relative to the driven element of the second modal antenna; and the driven element of the fourth modal antenna is rotated about ninety degrees relative to the driven element of the third modal antenna.

12. The multi-mode antenna system of claim 10, wherein the at least one parasitic element comprises a first parasitic element and a second parasitic element.

13. The multi-mode antenna system of claim 12, wherein:

the first parasitic element is disposed outside an antenna volume defined between the circuit board and the driven element; and the second parasitic element is disposed within the antenna volume.

14. The multi-mode antenna system of claim 13, wherein:

the first parasitic element of the second modal antenna is rotated about ninety degrees relative to the first parasitic element of the first modal antenna;

the first parasitic element of the third modal antenna is rotated about ninety degrees relative to the first parasitic element of the second modal antenna; and the first parasitic element of the fourth modal antenna is rotated about ninety degrees relative to the first parasitic element of the third modal antenna.

15. The multi-mode antenna system of claim 13, wherein the first parasitic element comprises:

a first linear portion coupled to the ground plane;

a second linear portion extending from the first linear portion, the second linear portion spaced apart from the ground plane and substantially perpendicular to the first linear portion; and a third linear portion extending from the second linear portion, the third linear portion spaced apart from the ground plane and substantially perpendicular to the second linear portion.

16. The multi-mode antenna system of claim 13, wherein:

the second parasitic element of the second modal antenna is rotated about ninety degrees relative to the second parasitic element of the first modal antenna;

the second parasitic element of the third modal antenna is rotated about ninety degrees relative to the second parasitic element of the second modal antenna; and the second parasitic element of the fourth modal antenna is rotated about ninety degrees relative to the second parasitic element of the third modal antenna.

17. The multi-mode antenna system of claim 11, further comprising:

a switching device configured to selectively couple one of the first modal antenna, the second modal antenna, the third modal antenna, and the fourth modal antenna to an RF source.

18. The multi-mode antenna system of claim 11, wherein:

the driven element of the first modal antenna, the driven element of the second modal antenna, the driven element of the third modal antenna, and the driven element of the fourth modal antenna are configured as an antenna array.

* * * * *